US006256865B1

(12) United States Patent
Larranaga et al.

(10) Patent No.: US 6,256,865 B1
(45) Date of Patent: Jul. 10, 2001

(54) CONTINUOUS WINDING PROCESS AND APPARATUS FOR ELECTRICAL TRANSFORMERS

(75) Inventors: Javier Larranaga, Bristol; Joe Criniti, New Britain; Farshid Attarian, Collinsville; Tom Campbell, Washington, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/326,295

(22) Filed: Jun. 7, 1999

(51) Int. Cl.[7] ..... H01F 41/06
(52) U.S. Cl. ..... 29/605; 29/606; 29/609
(58) Field of Search ..... 29/605, 606, 609, 29/596; 336/65, 92, 178, 198, 210, 96; 242/439.4, 440.1, 441

(56) References Cited

U.S. PATENT DOCUMENTS

| | | | | |
|---|---|---|---|---|
| 4,381,600 | | 5/1983 | Mas . | |
| 4,467,632 | * | 8/1984 | Klappert | 72/147 |
| 4,592,133 | | 6/1986 | Grimes et al. . | |
| 4,746,075 | * | 5/1988 | Hoxit | 242/7.16 |
| 4,924,240 | | 5/1990 | Herbert et al. . | |
| 5,515,597 | * | 5/1996 | Herbst et al. | 29/605 |
| 5,524,334 | * | 6/1996 | Boesel | 29/605 |
| 5,566,443 | * | 10/1996 | Allan et al. | 29/605 |
| 5,780,451 | | 7/1998 | DeMichele et al. . | |
| 5,793,273 | | 8/1998 | Yamaguchi et al. . | |
| 5,819,397 | * | 10/1998 | Knight et al. | 29/605 |
| 5,860,207 | | 1/1999 | Knight et al. . | |
| 5,892,420 | * | 4/1999 | Larranaga et al. | 335/18 |
| 6,145,774 | * | 11/2000 | Courtney, Jr. et al. | 242/434.7 |

* cited by examiner

*Primary Examiner*—Lee Young
*Assistant Examiner*—Minh Trinh
(74) *Attorney, Agent, or Firm*—Cantor Colburn LLP; Carl B. Horton

(57) ABSTRACT

A magnetic material is continuously wound in and through openings formed in a pair of bobbins to form a wound core of an electrical transformer by inserting the pair of bobbins into a cavity formed in a winding fixture, feeding the magnetic material into the winding fixture so that the magnetic material is fed into a circular winding action such that a leading edge of the magnetic material is continuously threaded into the openings formed in the pair of bobbins to form a wound transformer core, cutting the magnetic material to form a trailing edge, securing the trailing edge to underlying wound transformer core material, and shaping the wound transformer core to a predetermined shape.

9 Claims, 6 Drawing Sheets

CONTINUOUS WINDING PROCESS AND APPARATUS FOR ELECTRICAL TRANSFORMERS

BACKGROUND OF THE INVENTION

The present invention relates generally to electrical transformers, and more specifically, relates to a process and apparatus for continuous winding of a magnetic core strip in and around bobbins of pre-wound coils.

As is known, in the electronic industry, electrical transformers, e.g., current transformers, are often used in wide array of applications, including the use of electrical transformers with printed circuit boards and with circuit interruption devices. The electrical transformers are capable of providing power to the circuit board as well as sensing current in the primary circuit of the circuit board. In order for the electrical transformer to provide adequate power to the circuit board, the transformer has a high magnetic permeability core and the coil of the transformer has a high number of wire turns to provide the required voltage. One of the more common prior art transformers is a toroidally wound transformer. An associated disadvantage of the toroidally wound transformer is that the process of manufacturing and winding is very time consuming and also costly.

In the recent years, the related electronic industry has begun to wind coils about continuous lamination cores or closed magnetic cores of smaller transformers. Currently, most electrical transformer manufacturing processes require the utilization of laminated magnetic materials to produce a core arrangement required for the application. The laminated core process has become an industry standard for electrical transformers used in circuit interruption devices, e.g., breakers, relays, etc; however, this process is intrinsically complicated, labor intensive, and prone to failures.

Accordingly, all of the above-mentioned transformer winding processes are labor intensive processes and costly. Accordingly, it would be desirable to have a less labor-intensive generally automated process of producing electrical transformers.

BRIEF SUMMARY OF THE INVENTION

The present invention is directed to a continuous core winding process and winding apparatus used to produce electrical transformers. In its assembled state, the preferred electrical transformer comprises a double coil transformer having a first and a second bobbin. The electrical transformer may also be in the form a single coil transformer having a first bobbin. Each of the first and second bobbins has a wire turn disposed around a respective bobbin. An electrical connection is made between the wire turns to electrically connect one another. Each of the bobbins includes a central opening in which a magnetic material strip is continuously wound around to form a wound transformer core.

In an exemplary embodiment, the apparatus includes a first station, a second station, and a third station. At the first station, raw magnetic material strip is de-reeled from a stock reel and a predetermined amount of the raw magnetic material strip is fed and measured as the magnetic material strip is transported to a winding mechanism. In the winding mechanism, the magnetic material strip is continuously wound in and through the openings of each bobbin to form the wound transformer core. After winding the predetermined amount of magnetic material strip through the bobbins, the magnetic material strip is cut at a predetermined measured location to produce a trailing edge of material. At the second station, the trailing edge is secured to the underlying coils by a suitable process, e.g., plasma welding the trailing edge to the underlying coils. At the third station, the wound core of magnetic material is coined into a desired shape, such as a generally rectangular shape.

The apparatus of the present invention is preferably controlled by a microprocessor so that all mechanical and electrical components of the apparatus are preferably integrated to achieve the optimum quality product and achieve the optimum manufacturing cycle. The present process of winding magnetic material strip around the bobbins using the apparatus of the present invention provides a less-time consuming process as compared to the prior art.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several Figures.

DETAILED DESCRIPTION OF THE INVENTION

Figure 1:
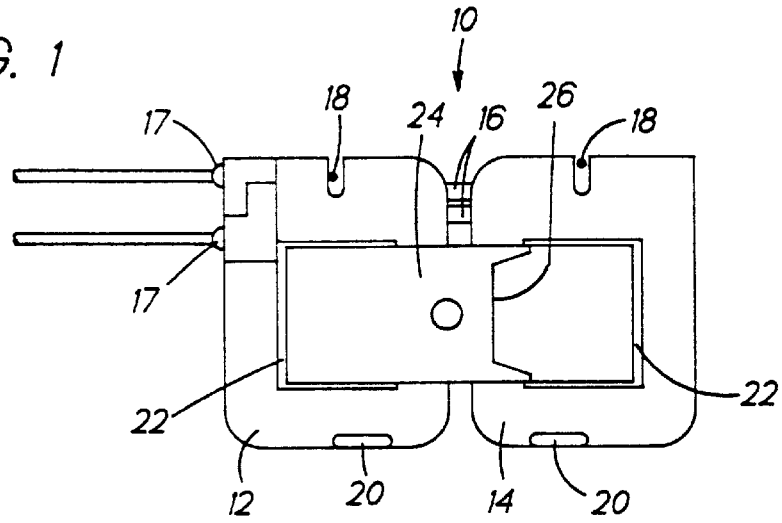
FIG. 1 is a front elevation view of an electrical transformer formed in accordance with the process of the present invention.

Referring to FIG. 1, an exemplary electrical transformer produced in accordance with the process and apparatus of the present invention is generally indicated at 10. In this exemplary embodiment, electrical transformer 10 comprises a double coil transformer having a first bobbin 12 and a second bobbin 14. Disposed around each of first and second bobbins 12 and 14 is a wire turn (not shown), the use of which is known in the art. An electrical connection is made between the wire. Typically, this electrical connection is formed by at least one electrical wire 16. In the illustrated embodiment, each of bobbins 12 and 14 has a pair of slots 18 formed therein. Slots 18 provide an access location for a pair of electrical wires 16 to run between the wire turns disposed around each of bobbins 12 and 14. Each of the pair of electrical wires 16 terminates in an electrical prong 17 which provides a means for electrically connecting electrical transformer 10 to another device. As is known in the art, a bobbin having turn wire wrapped around and surrounding the bobbin is commonly referred to as a coil. Each of bobbins 12 and 14 further includes a tab 20 which outwardly extends from a side surface thereof. Tab 20 is designed to centralize the transformer assembly with respect to the tooling. A central opening 22 is formed in each of bobbins 12 and 14. In this embodiment, central opening 22 is generally rectangular in shape; however, it is understood that central opening 22 may have a variety of shapes.

Electrical transformer 10 includes a wound core of magnetic material 24 which, in the illustrated embodiment, is directed through central openings 22 of first and second bobbins 12 and 14. Magnetic material 24 is preferably in the form of a magnetic material strip which is continuously wound around first and second bobbins 12 and 14 through openings 22 to form a wound transformer core. After magnetic material 24 is wound to a predetermined thickness around first and second bobbins 12 and 14, respectively, it is cut at a predetermined location to form a trailing edge 26 of magnetic material 24. Trailing edge 26 is secured to the remaining portion of magnetic material 24 by welding trailing edge 26 to the underlying coiled portion of magnetic material 24. It is also within the scope of the present invention that electrical transformer 10 may comprise a single bobbin 12 having opening 22 formed therein, wherein magnetic material 24 is wound through opening 22 of single bobbin 12.

Electrical transformer 10 of FIG. 1 may be used in a variety of settings and in an exemplary and preferred embodiment, electrical transformer 10 is used in circuit interruption devices, e.g., circuit breakers, relays, and the like. Electrical transformer 10 is particularly used as a device to sense current in these apparatuses.

Referring to FIGS. 1 and 2–7 in which an exemplary continuous winding process and apparatus for winding magnetic material core 24 around one or more bobbins 12, 14 of electrical transformer 10 are illustrated. An exemplary apparatus 30 may be broadly thought of as having a plurality of stations, wherein at least one specific task is performed at each station. For example, apparatus 30 includes a first station 32 including a first stage where a predetermined amount of raw magnetic material 24 is de-reeled, a second stage where magnetic material 24 is fed and measured, a third stage where magnetic material 24 is wound around one or more bobbins 12, 14, and a fourth stage where one end (trailing edge 26) of magnetic material 24 is cut and securely held in place against the underlying coiled magnetic material 24. A second station 34 is provided to securely couple trailing edge 26 to the underlying coiled portion of magnetic material 24 so that magnetic material 24 is securely wrapped in and around one or more bobbins 12, 14. At a third station 36, magnetic material 24 is preferably coined into a desired and predetermined shape, such as a generally rectangular shape.

It being understood that the various tasks previously described may be apportioned differently amongst a plurality of stations or sections of apparatus 30. The above-described stations are described for purpose of illustration and do not limit the scope of the present invention. In other words and for example, a separate station for cutting magnetic material 24 may be designed into apparatus 30 instead of having the cutting function be incorporated into first station 32. As shown, the components of apparatus 30 are mounted to a support bench 33.

Figure 3:
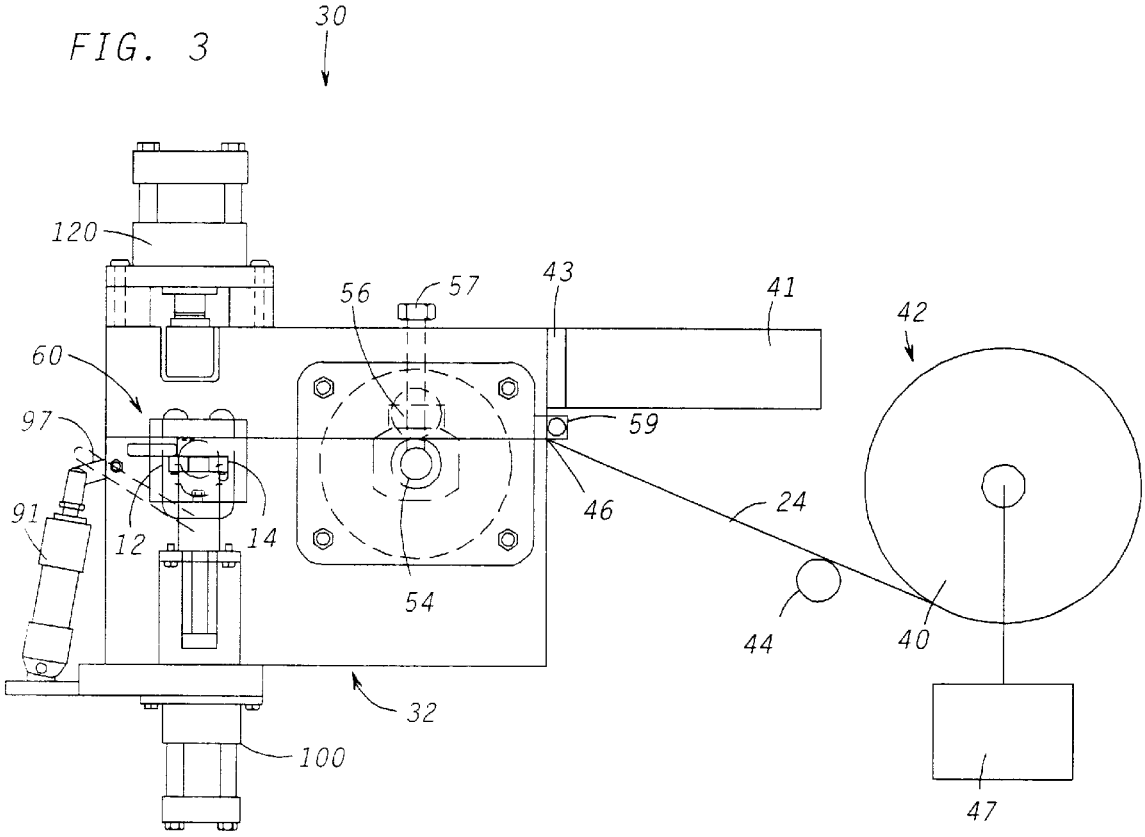
FIG. 3 is a side elevation view of a first station of the apparatus of FIG. 2.

Referring to FIGS. 1 and 3, magnetic material 24 is available in a variety of dimensions and in particular, magnetic material 24 is available in a range of widths and thicknesses. In fabricating electrical transformer 10, the number of coil turns of magnetic material 24 (total amount of magnetic material 24) in and around bobbins 12 and 14 depends upon the thickness of magnetic material 24 being fed into apparatus 30.

Now describing the first and second stages of first station 32, conventional feeding devices may be used to supply magnetic material 24 to apparatus 30. In an exemplary embodiment, magnetic material 24 is supplied as a magnetic material strip disposed on a reel 40. A de-reeler assembly, generally shown at 42, is provided to uncoil magnetic material 24 from reel 40. De-reeler assembly 42 may be motorized or unmotorized so that magnetic material 24 is easily and properly fed into apparatus 30.

Motorized de-reeler assembly 42 is driven by various means including by use of a motor 47 which acts to unwind magnetic material 24 from reel 40. The preferred embodiment further includes a servomotor 41 that acts to drive a pair of pinch rollers 54 and 56 which act to drvie magnetic material 24 into first station 32. The servomotor 41 preferably includes an encoder 43 that permits a predetermined amount of magnetic material 24 to be fed into first station 32 of apparatus 30. Encoder 43 measures the amount of material that is being fed by the driving action of servomotor 41.

As is known in electrical transformer technology, the amount of magnetic material 24 (surface area) of the laminated or in the case of the present invention the continuous coil (wrapped magnetic material core 24) is related to the current output of the transformer. At this second stage, apparatus 30 provides the means to feed and accurately measure the correct amount of magnetic material strip 24 to be coiled around first and second bobbins 12 and 14. In one exemplary embodiment, approximately 110 inches of magnetic material 24 is fed to station 32 and wrapped in and around bobbins 12 and 14 disposed therein as will be described in greater detail hereinafter. When determining what the desired amount of magnetic material 24 is for being fed into first station 32, encoder 43 will continuously measure the length of magnetic material 24 being fed so that the proper amount of magnetic material 24 to be fed into first station 24 may be easily determined. Alternatively, the length of magnetic material 24 being fed may also be determined by a regular motor instead of a servomotor 41, wherein the regular motor includes a resolver to measure the length of material.

Optionally, apparatus 30 further includes an external encoder (not shown) which also measures the amount of magnetic material 24 that is being fed into first station 32 of apparatus 30. This serves as a backup system for encoder 43 included within the servomotor 41 so that the desired and appropriate amount of magnetic material is fed into first station 32. Other known encoding devices may be used in combination with apparatus 30 of the present invention.

All the feed and measurement systems work in conjunction with a PC or PLC base processor that provides the desired length for a particular electrical transformer 10 to the system. Because of possible variations of the thickness (tolerance) of magnetic material strip 24, at least one thickness measuring device 59 constantly measures the thickness of magnetic material strip 24 before magnetic material 24 reaches the thickness measuring device 59 and provides information to the system to interpolate the exact length necessary at this thickness, to achieve the correct amount of magnetic material 24 on electrical transformer 10. Thickness measuring device 59 comprises a contact or non-contact device and in an exemplary embodiment, thickness measuring device 59 comprises at least one roller which acts to measure the thickness of magnetic material 24 prior to pinch rollers 54 and 56. In another embodiment, thickness measuring device 59 comprises a thickness measuring gauge or a laser device. Furthermore, a resolver may be used to measure the thickness of magnetic material 24. It is further within the scope of the present invention that thickness measuring device 59 may be located so that device 59 measures the thickness of magnetic material 24 either prior to or subsequent to when magnetic material 24 passes through pinch rollers 54 and 56. The system constantly updates the servomotor 41 as to the amount of material to be fed. This level of measurement assures that no variations occur in the present process because of material deviations.

In one exemplary embodiment, the measurement of magnetic material strip 24 is preferably accomplished by comparing data from servomotor 41 with data provided by a resolver 61 mounted in the pinch roller assembly. The correlation of this data provides the exact measurement of magnetic material strip 24 being fed into a winding mechanism 60 (winding fixture) of apparatus 10. Again, the measurement of magnetic material strip 24 can be accomplished by the interaction in apparatus 10 of one or more devices acting on their own or in conjunction with others. Some of the possible measuring means include but are not limited to laser sensors, ultrasonic sensors, infrared sensors, encoders, etc.

If the thickness of magnetic material 24 is at a low tolerance point of a predetermined thickness tolerance range, additional coil turns in and around first and second bobbins 12 and 14 are needed so that the overall thickness of the core of magnetic material 24 is within the predetermined limits. Conversely, if the thickness of magnetic material 24 is at a high tolerance point, the number of coil turns in and around first and second bobbins 12 and 14 may be reduced. Thus, the de-reeling operation allows a certain amount of magnetic material 24 to be free of the main material coil (reel 40) at all times so that the feed system of the present invention does not have to excerpt force to actually pull raw magnetic material 24 out of reel 40 but just pull the loose magnetic material strip 24. This de-reeling is accomplished throughout the operation of the present process by the interaction of a switch that is triggered when magnetic material strip 24 starts to get tense. In other words, the switch controls the on/off cycles of motor 47 and when the switch is on and motor 47 is likewise in the on position, a slack of magnetic material 24 is generated so that magnetic material 24 is loosely available to be driven into apparatus 30. Thus, this switch allows motor 47 of the de-reeler assembly 42 to release magnetic material 24 until the switch changes state again and magnetic material 24 is not actively unwound and thus as magnetic material 24 is driven into apparatus 30, tension is created in magnetic material 24 as it is pulled into apparatus 30. Once the tension reaches a predetermined point, the switch changes state again and magnetic material 24is unwound from reel 40 by motor 47.

Optionally, at least one roller 44 may be provided to direct magnetic material strip 24 from reel 30 to an intake port 46 of apparatus 30. Intake port 46 is preferably a slot in apparatus 30 which is sized to receive magnetic material strip 24. Also, preferably provided proximate intake port 46 is a lubricating device (not shown) which disperses a small amount of lubricant on a top surface of magnetic material 24 strip as magnetic material 24 strip is being fed into first station 32 and wound around first and second bobbins 12 and 14. During the winding process in which magnetic material 24 is continuously wound on top of itself as it winds in and around first and second bobbins 12 and 14, respectively, a certain amount of resistance (drag and friction) is developed. This resistance increases as magnetic material strip 24 is continuously wound. To reduce this level of resistance and permit magnetic material strip 24 to be more easily fed into and through first station 32, the lubricant is dispersed onto the top surface thereof. This lubricant can be of many types, e.g., oil based lubricant and even a soap base mix. Any number of conventional lubricating devices to apply the lubricant may be used and in an exemplary embodiment, an oiler drips oil into a wiper mechanism which in turn applies the oil to the top surface of magnetic material strip 24 before it advances further into first station 32, where magnetic material strip 24 is wound in the third stage. The lubricant may also be applied by spraying, dripping, brushing, to name a few.

The feeding of magnetic material strip 24 into apparatus 10, more specifically into winding mechanism 60, is preferably accomplished by the pair of pinch rollers 54 and 56 that press on the magnetic material strip 24 with adjustable force and that rotate under the power of the servomotor. Pinch rollers 54 and 56 are disposed after magnetic material 24 is lubricated but prior to entering winding mechanism 60. In the exemplary embodiment pinch roller 54 is a stationary pinch roller and pinch roller 56 is a moveable pinch roller. The force that is provided by the pair of pinch rollers 54 and 56 can be generated a variety of ways, pneumatically, mechanically, electrically, or by hydraulic means. A pinch roller tensioner 57 may be used to adjust the force being applied by pinch roller 56. The rotational force to pinch rollers 54 and 56 can also be accomplished by means other than a servomotor. For example, a stepping motor, standard motor, air power devices, and the like may be used to generate the rotational force.

Referring to FIGS. 1 and 3–5, the third stage of first station 32 provides the area where the winding of magnetic material 24 takes place. Individually pre-wound first and second bobbins 12 and 14 with the main conductor (bar or wire 16) extending therebetween form a pre-wound bobbin assembly 31 which is placed by hand or automatically into winding mechanism 60. The placement of the pre-wound bobbin assembly 31 can be achieved by utilizing a human operator, a robot, or a hard automation device. Once in place the pre-wound bobbin assembly 31 will be the body that magnetic material 24 will wind around to form electrical transformer 10. It is within the scope of the present invention that winding mechanism 60 could be set to wind a single bobbin or a double bobbin. When a single bobbin (one of first and second bobbins 12 and 14) is placed in winding assembly 60, first and second dies 62 and 64 are modified so that the arcuate surfaces formed therein cause magnetic material 24 to be wound through opening 22 and around the bobbin 12 or 14.

Figure 4:
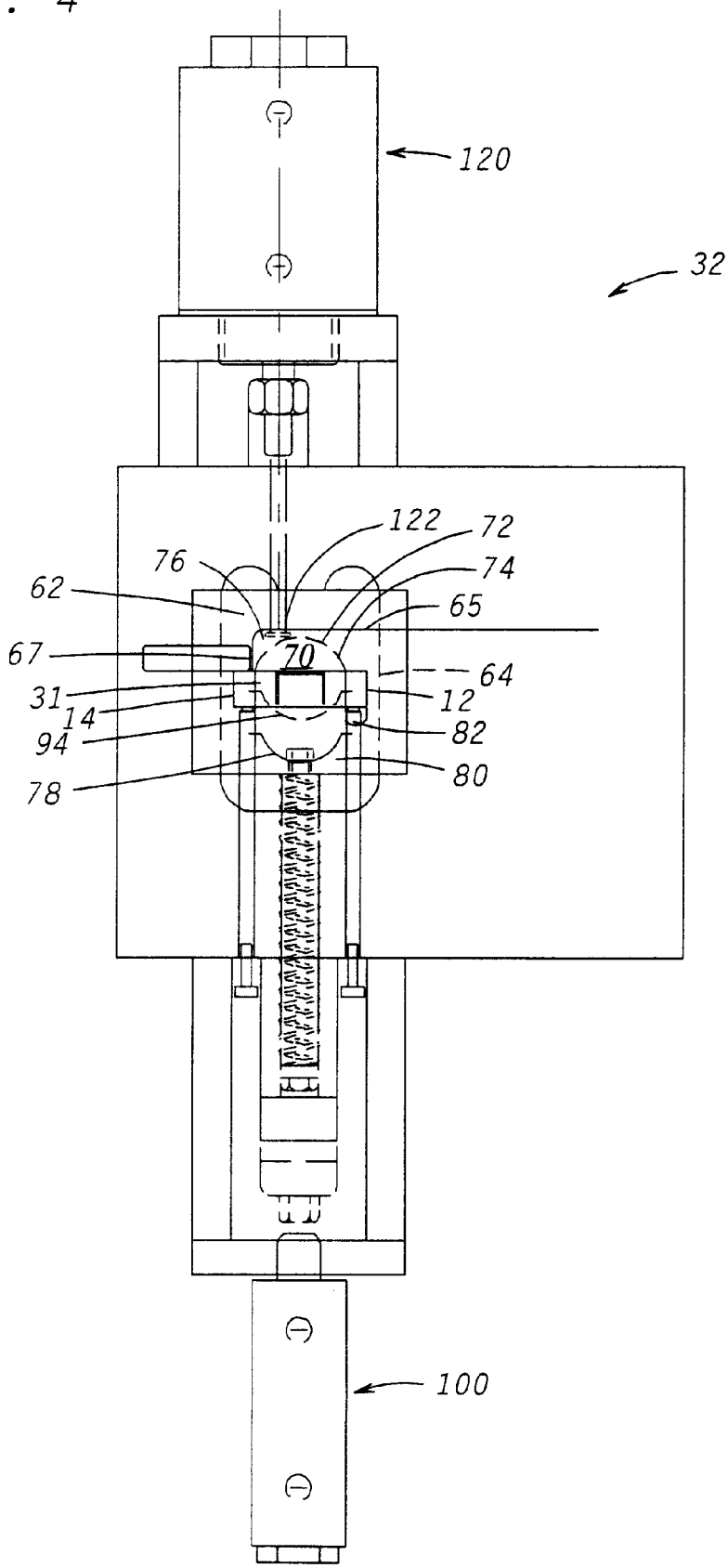
FIG. 4 is an enlarged view of a portion of the first station of FIG. 3.
Figure 5:
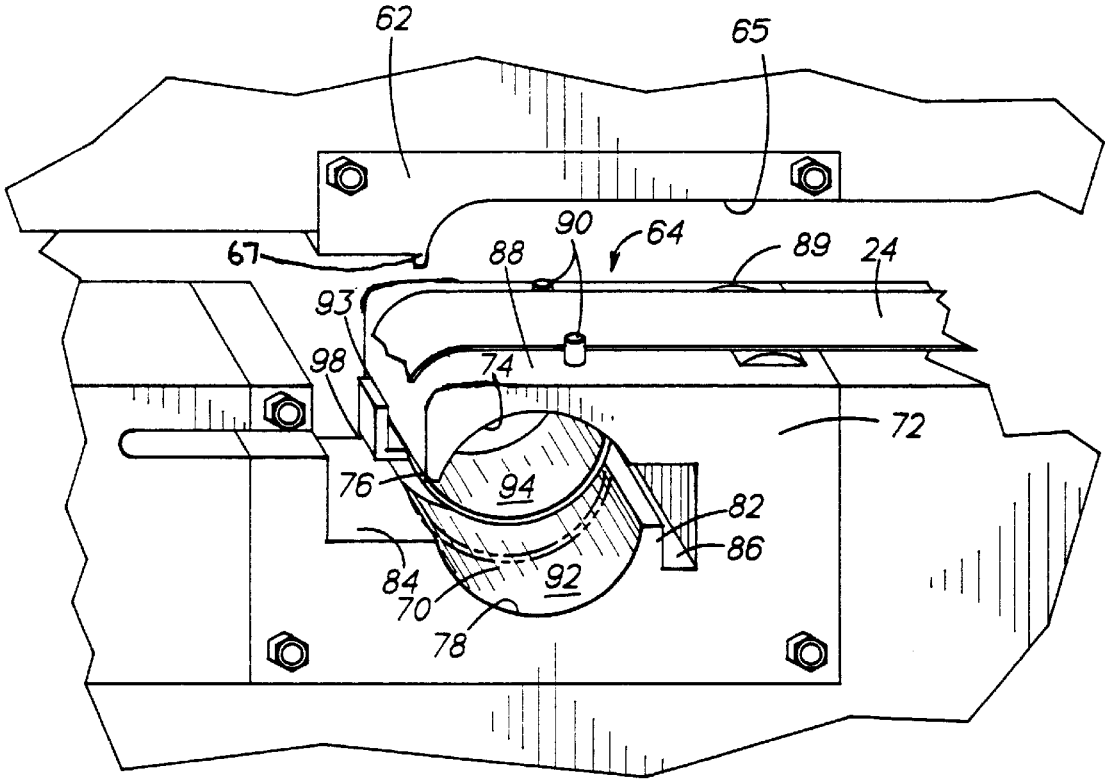
FIG. 5 is a perspective view of a winding surface for use in a winding device of the first station.

As best shown in FIGS. 4 and 5, in the exemplary and illustrated embodiment, winding mechanism 60 has a split die design including a first die 62 and a second die 64. First die 62 has a first guide lip 67 proximate a first end 66 extending downwardly from a lower surface 65 toward second die 64. When first and second dies 62 and 64 are in a closed position, a slot 69 is formed between first die 62 and second die 64. Slot 69 receives magnetic material strip 24 which travels within slot 69 toward first guide lip 67 during the feeding of magnetic material 24 in winding mechanism 60.

Second die 64 defines a cavity 70 formed therein, wherein in the exemplary embodiment cavity 70 is generally circular in shape. More specifically, second die 64 has an upper portion 72 which includes a first surface 74 formed therein. Preferably, first surface 74 is a first concave surface. Upper portion 72 further includes a first end 76 which is proximate first guide lip 67 when first and second dies 62 and 64 are in the closed position. Cavity 70 is also defined by a second surface 78 which is formed in a lower portion 80 of second die 64 and is preferably a second concave surface. A guide shoulder 82 is formed in lower portion 80 at one end of second concave surface 78 and a stepped shoulder 84 is formed in lower portion 80 at an opposite end of second concave surface 78, wherein this opposite end ramps up to stepped shoulder 84 which extends away from second concave surface 78 and receives one of bobbins 12 and 14. Second die 64 further includes a recess 86 formed therein adjacent guide shoulder 82 for receiving the other of bobbins 12 and 14.

At upper portion 72 opposite first concave surface 74 is a guide surface 88. Guide surface 88 faces lower surface 65 of first die 62 and partially defines the slot. In an exemplary embodiment, magnetic material strip 24 is driven across guide surface 88 between first and second dies 62 and 64 by at least one guide roller 89. In addition, guide pins 90 may be provided on guide surface 88 for properly locating and guiding magnetic material 24 across guide surface 88 toward first guide lip 67 of first die 62. As magnetic material strip 24 is fed across guide surface 88 it follows the contour of bottom surface 65 of first die 62. Because first guide lip 67 comprises an arcuate bend, it causes magnetic material 24 to ramp downward toward cavity 70 of second die 64.

Referring to FIGS. 1–5, the winding process of the present invention will be described in more detail as follows. The exemplary winding mechanism 60 shown in detail in FIGS. 4 and 5 is intended to receive and wind two bobbins, namely first and second pre-wound bobbin assembly 31. First bobbin 12 is preferably received in cavity 70 so that one end of first bobbin 12 seats against stepped shoulder 84. Second bobbin 14 is disposed within cavity 70 so that one end thereof is received in recess 86, wherein a portion of second bobbin 14 rests upon second guide lip 82.

Second concave surface 78 includes a base surface 92 and an expanding surface 94 which in a retracted position rests upon base surface 92. Expanding surface 94 preferably has the same arcuate shape as base surface 92 with the exception that a width of expanding surface 94 is preferably about ½ a width of the underlying base surface 92. Consequently, in the retracted position, half of base surface 92 is covered by expanding surface 94. Expanding surface 94 also includes a guide tab 98 which acts to locate and guide magnetic material strip 24 downwardly from guide surface 88 to expanding surface 94. As best shown in FIG. 5, in the expanded position, expanding surface 94 is upwardly disposed relative to base surface 92. Expanding surface 94 is also preferably concave in nature, similar to first and second concave surfaces 74 and 78, to provide encouragement for magnetic material strip 24 to wind around pre-wound bobbin assembly 31 during the winding process of the present invention, as will be described in greater detail hereinafter.

The movement of expanding surface 94 by actuator 100 to cause expanding surface 94 to move from the retracted position to the expanded position and vice versa may be accomplished by known means. For example, in the exemplary embodiment, a spring-loaded pneumatically operated retractor cylinder device 100 is used to apply a predetermined force to expanding surface 94 to move expanding surface 94 in a direction away from base surface 92 to the expanded position. Expanding surface 94 is initially positioned in a retracted position so that pre-wound bobbin assembly 31 may be inserted into cavity 70. After inserting pre-wound bobbin assembly 31 in cavity 70 of winding mechanism 60, expanding surface 94 is moved to the expanded position in a direction toward first concave surface 74.

When expanding surface 94 is in the expanded position, the overall area of cavity 70 is reduced so that magnetic material strip 24 more tightly winds around pre-wound bobbin assembly 31 because the surface area in which the winding occurs is reduced. In addition, the actuation of expanding surface 94 will accordingly cause guide tab 98 to move in a direction away from base surface 92 and this movement results in a gap 93 being formed between guide tab 98 and guide surface 88, wherein magnetic material strip 24 is fed through gap 93 and around the arcuate surface (inner diameter) of expanding surface 94.

In other words, during the feeding and winding operations, winding mechanism 60 provides the mechanical means to force magnetic material strip 24 in a linear motion along guide surface 88, into a circular winding action around expanding surface 94 in both the retracted and extended positions. This change in direction is achieved by providing the leading edge of magnetic material strip 24 with a gradual change in direction and mechanically guiding this motion so that the leading edge threads itself into the center openings 22 of first and second bobbins 12 and 14. Once the leading edge of magnetic material strip 24 reaches winding mechanism 60, the first die 12 provides the encouragement for magnetic material strip 24 to find opening 22 in first bobbin 12, once past first bobbin 12, second die 14 provides the direction for the material to find opening 22 in second die 14. The arcuate nature of expanding surface 94 in the retracted position against second surface 14 directs magnetic material strip 24 toward and through opening 22 in second bobbin 14 and then first concave surface 74 of upper portion 72 of second die 14 directs magnetic material strip 24 toward opening 22 in first bobbin 12. Once the first revolution has been accomplished inside of winding mechanism 60 and through openings 22 in bobbins 12 and 14, magnetic material strip 24 will continuously be force fed making the leading edge travel through the inside of the walls of first and second bobbins 12 and 14, respectively, as the rest of magnetic material strip 24 winds over itself.

As the magnetic material strip 24 is wound a predetermined number of revolutions around first and second bobbins 12 and 14, actuator 100 causes expanded surface 94 to move from the retracted position to the expanded position resulting in less surface area for magnetic material strip 24 to be wound around first and second bobbins 12 and 14. In the preferred embodiment, actuator 100 comprises a spring loaded pneumatic cylinder which applies a predetermined amount of pressure to hold expanded surface 94 in the expanded position as magnetic material strip 24 is continuously being wound. The force applied by pneumatic cylinder 100 is adjustable so that by controlling the air pressure of device 100, the resistance generated is likewise controlled. As magnetic material strip 24 is continuously being wound around pre-wound bobbin assembly 31, the coil (magnetic material strip 24) continuously increases in diameter. Because of the split die design of apparatus 10, expanding surface 94 and first arcuate surface 74 of second die 14 are maintained in the same x-axis centerline but expanding surface 94 is permitted to move in the z-axis as the coil (magnetic material strip 24) is wound and increases in diameter. Accordingly, the centerline of an inside diameter of expanding surface 94 is preferably centered to a centerline of magnetic material strip 24 so that the winding process proceeds in a smooth and even manner.

Accordingly, the coil expansion is taken by the force loaded expanding surface 94 of winding mechanism 60. In other words, as the diameter of the coils formed of magnetic material strip 24 increases, a force in a direction counter to the force generated by actuator 100 is generated. At some point, this counter force overcomes the adjustable force of actuator 100 causing expanding surface 94 to move in a direction toward base surface 92 of second die 64. The force applied by actuator 100 can be varied for the application as to permit more or less resistance to magnetic material strip 24 as it winds within cavity 70, namely expanding surface 94 and first concave 74 of second die 14. These actions can easily be processor controlled, as is known in the art.

In the fourth stage of first station 32 and as best shown in FIG. 4, once a predetermined and desired amount of magnetic material strip 24 is wound through openings 22 of first and second bobbins 12 and 14, a cutter assembly 120 is actuated to provide a cut at a predetermined location so as to maintain the correct length of magnetic material strip 24. As shown in FIG. 4, preferably cutter assembly 120 is designed into first die 12 and guide surface 88 (FIG. 5) of second die 14 so that magnetic material strip 24 is cut at a cutting position along the length of guide surface 88 proximate first guide lip 67. Cutting assembly 120 comprises any suitable number of cutting devices. In the exemplary embodiment shown in FIG. 4, cutter assembly 120 comprises an impact cylinder including a cutting head 122 at one end which is driven downward to cut magnetic material strip 24 upon actuation of cutting assembly 120. Preferably, cutting assembly 120 mechanically holds magnetic material strip 24 after it has been cut so as to prevent unraveling thereof or so that trailing edge 26 (FIG. 1) will not loose the tension therein. This may be accomplished using a variety of holding mechanisms.

Figure 6:
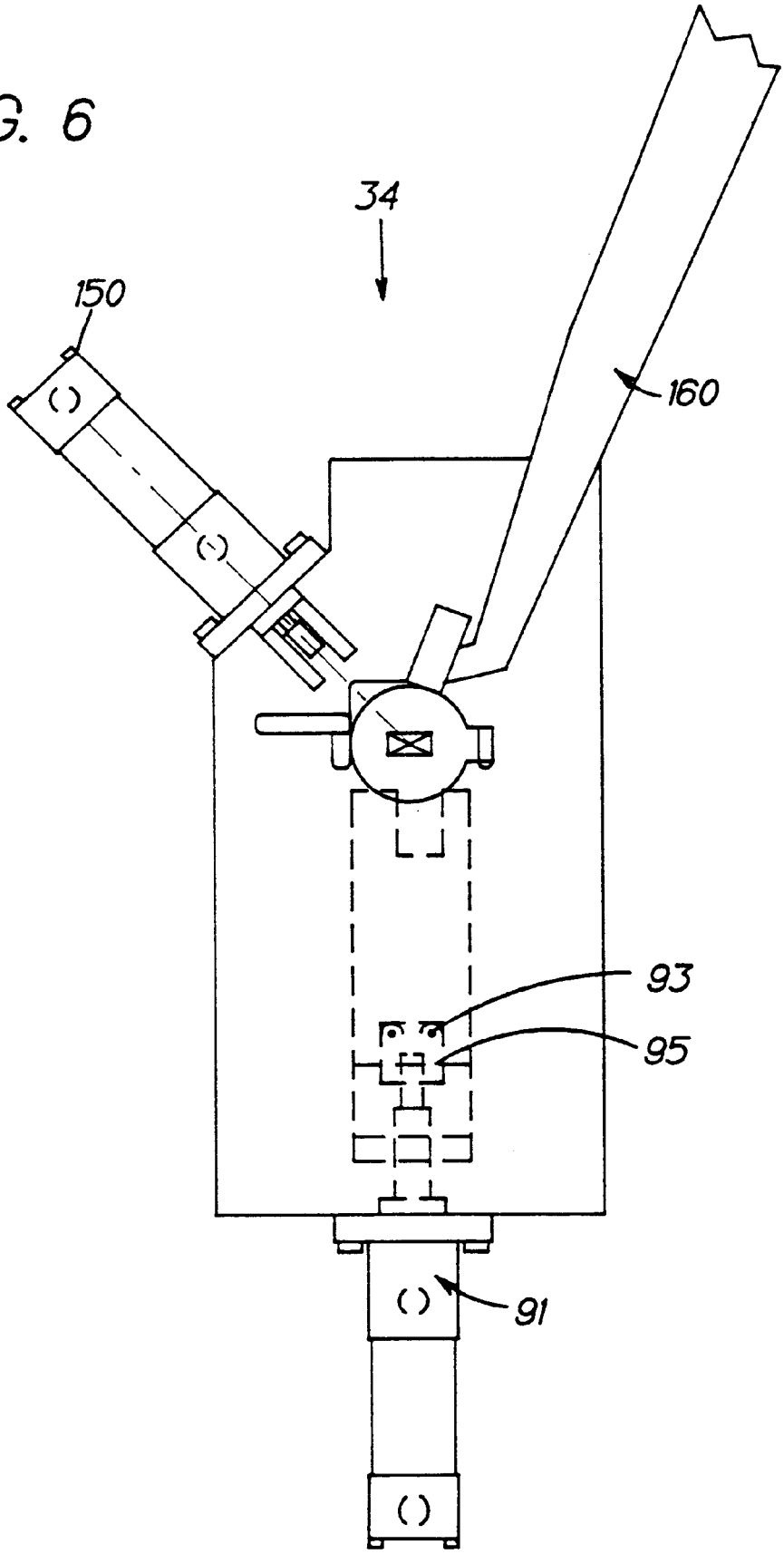
FIG. 6 is a side elevation view of a second station of the apparatus of FIG. 2.

Referring to FIGS. 3 and 6, apparatus 30 also preferably includes a stop gate device 91 which serves to locate pre-wound bobbin assembly 31 within winding mechanism 60. In the exemplary and illustrated embodiment, stop gate device 91 includes a stop gate 93 which in a first activated position extends upward from a planar surface 95 adjacent winding mechanism 60 and extending between first station 32 and second station 34 so that when pre-wound bobbin assembly 31 is placed into winding mechanism 60 it is located within first station 32 and access to second station 34 is prevented. Stop gate device 91 may comprise any number of known stopping devices, and in this embodiment stop gate device 91 comprises a pneumatic cylinder which upon actuation causes stop gate 93 to go from a retracted position within an opening in the planar surface 95 to the first activated position shown in FIG. 6. As shown in FIG. 3, linkage 97 connects at one end to a first end of stop gate device 91 and connects at an opposite end to stop gate 93. Thus, stop guide 93 acts to locate pre-wound bobbin assembly 31 in the y direction. It being understood that stop gate device 91 shown in FIGS. 3 and 6 is merely exemplary and illustrative in nature and does not limit the scope of the present invention.

Figure 2:
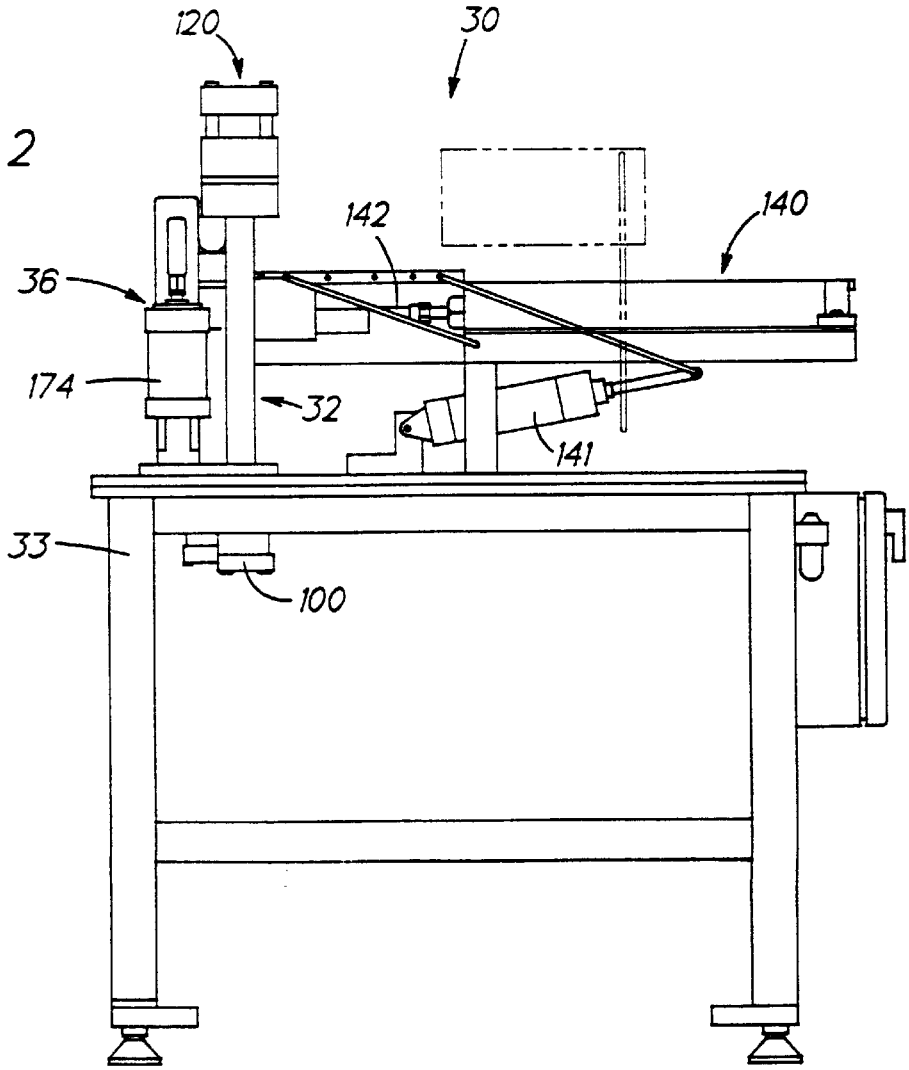
FIG. 2 is side elevation view of an exemplary apparatus for continuous core winding of electrical transformers in accordance with the present invention.

Referring to FIGS. 2–5, stop gate 93, which locates pre-wound bobbin assembly 31 within cavity 70 of winding mechanism 60 during the winding process, is retracted, thereby allowing access to second station 34. To transfer pre-wound bobbin assembly 31 having magnetic material strip 24 wound there around from first station 32 to second station 34, a conventional drive device 140 may be used. In the exemplary embodiment of the present invention and as best shown in FIG. 2, drive device 140 includes a pneumatic cylinder 141 having an extendable first end 142 which contacts and physically moves wound first and second bobbins 12 and 14 from first station 32 to second station 34 upon actuation of drive device 140. As is known, drive device 140 preferably includes a microprocessor control which permits drive device 140 to be programmed so that first end 142 of drive device 140 extends toward and within cavity 70 and drives wound first and second bobbins 12 and 14 away from first station 32 and into second station 34. Accordingly, first end 142 is preferably circular in shape and complementary in shape to cavity 70 to permit first end 142 to be received and driven therethrough. Because drive device 140 is programmed, wound first and second bobbins 12 and 14 are driven only a predetermined distance to properly locate bobbins 12 and 14 within a central portion of second station 34. During this driving action, the trailing edge 26 of magnetic material strip 24 is held in place to prevent unwinding thereof.

After having located wound first and second bobbins 12 and 14 within second station 34, first end 142 is retracted out of cavity 70 so that a second pre-wound bobbin assembly 31 may be inserted into cavity 70 and the winding process may be started over again. Furthermore, before inserting this second pre-wound bobbin assembly 31 into cavity 70, expanding surface 94 is likewise retracted.

FIG. 6 shows second station 34 in more detail, wherein electric transformer 10 of FIG. 1 is further manufactured. After wound first and second bobbins 12 and 14 are transferred into second station 34, trailing edge 26 of magnetic material strip 24 is secured to the underlying coils. Trailing edge 26 is securely held in place against the underlying coils by a tail clamp assembly 150. In an exemplary embodiment, tail clamp assembly 150 comprises a pneumatic tail clamp cylinder which applies a predetermined force to trailing edge 26 so as to securely hold trailing edge 26 against the underlying coils. Other retaining means may be used to securely hold trailing edge 26 in this position.

Subsequently, the coils forming magnetic material strip 24 are secured to one another by any suitable process. In one embodiment, a predetermined location of trailing edge 26 is welded to the underlying coils by a device 160 to form a secured, coiled assembly. One exemplary welding process is a plasma welding process using argon gas in a plasma welder 160. It being understood that other securing means may be used including but not limited to laser welding, resistance welding, case-welding, bonding, mechanically lancing or crimping, strapping the diameter of the coil, and the use of wire wraps. After the securing process is complete, trailing edge 26 is secured to the underling coils to form a tightly wound coil.

Figure 7:
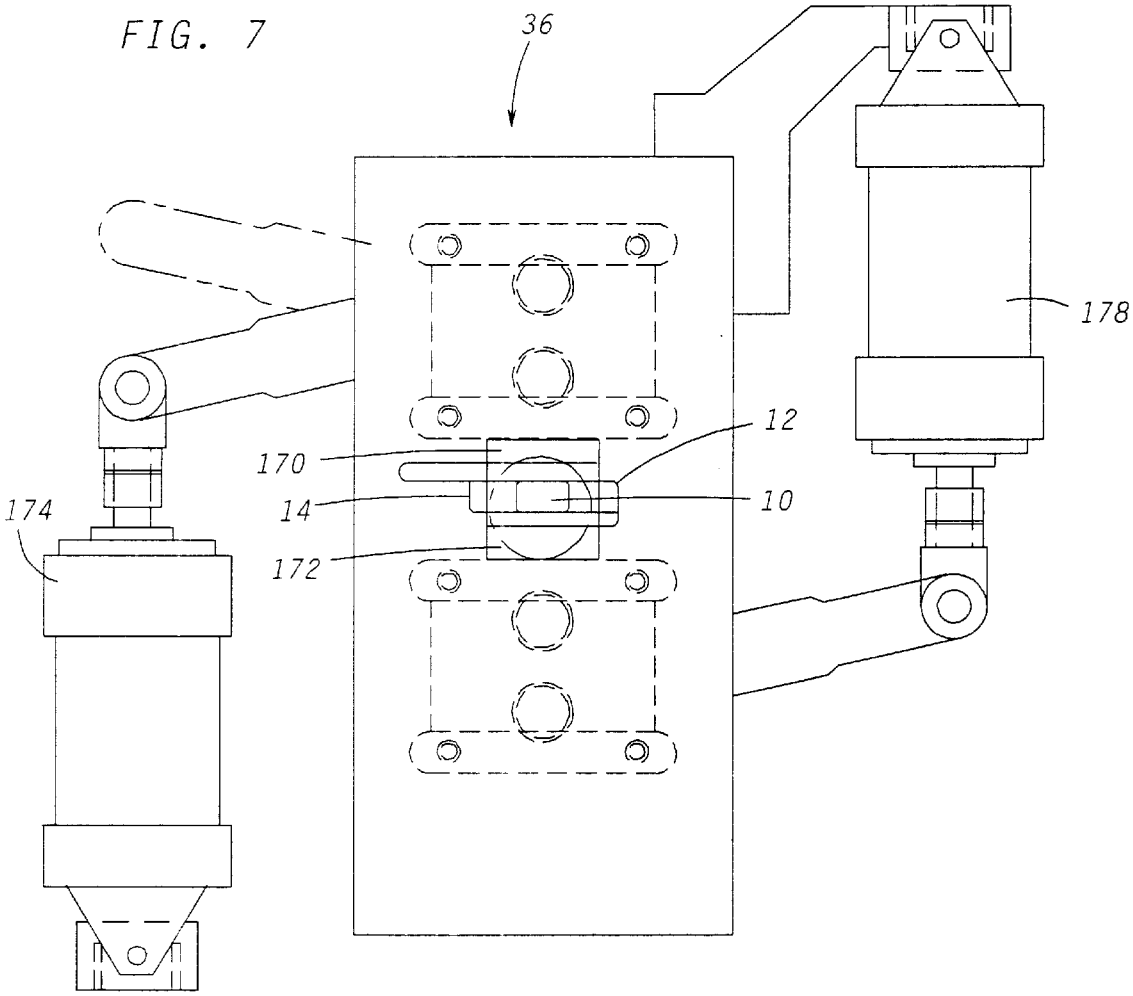
FIG. 7 is a side elevation view of a third station of the apparatus of FIG. 2.

In apparatus 10 of the present invention, wound first and second bobbins 12 and 14 remain located within second station 34 after trailing edge 26 has been secured. Tail clamp assembly 150 is retracted so that wound first and second bobbins 12 and 14 are free to be transferred to third station 36 (FIG. 7). In the present invention, wound first and second bobbins 12 and 14 remain freely positioned within second station 34 until another wound first and second bobbin assembly from first station 34 is driven into second station 36, thereby displacing the wound first and second bobbin assembly located in second station 34. Thus, the driving action of the bobbin assembly from first station 32 forces the bobbin assembly in second station 34 into third station 36. It being understood that it is within the scope of the present invention, that other drive mechanisms may be used to drive the bobbin assembly from second station 34 to third station 36.

Referring now to FIGS. 1 and 7, third station 36 is illustrated in FIG. 7 and generally includes a coining process which encompasses the forming or shaping of the wound coil of magnetic material 24. The wound coil of magnetic material 24 is preferably coined or shaped to fit the coil to a geometry that fits the design of the product (electrical transformer 10). In an exemplary embodiment, third station 36 includes a first form die 170 and a second form die 172. First form die 170 is driven by a first actuator 174, which in the present embodiment comprises a first pneumatic cylinder which applies a force in a first direction to a top surface of the wound coil of magnetic material 24. Second form die 172 is driven by a second actuator 178. Preferably, second actuator 178 comprises a second pneumatic cylinder which applies a force in a second direction to a bottom surface of wound coil of magnetic material 24. It being understood that the first and second directions are generally opposite one another so as to compact or coin the wound coil between first and second form dies 170 and 172 upon actuation of both. As is known, the coined shape of electrical transformer 10 may easily be varied by changing the shape of first and second die forms 170 and 172.

Once wound coil of magnetic material 24 has been coined to form electrical transformer 10, first and second form dies 170 and 172 are retracted and electrical transformer 10 remains in place in third station 36 until another wound coil assembly from second station 34 is driven into third station 36 resulting in the displacement of electrical transformer 10 from third station 36. A chute (not shown) may be provided leading to a receptacle (not shown) which catches electrical transformers 10 as they are displaced from third station 36 in a fully assembled state. It being understood that a driving device (not shown) may be provided to mechanically transfer and displace assembled electrical transformer 10 from third station 36 after first and second form dies 170 and 172 retract from one another.

Apparatus 30 of the present invention and the process of forming electrical transformer 10 are preferably controlled by a microprocessor (not shown). All electrical and mechanical components of apparatus 30 are integrated to achieve the best quality product that meets all predetermined specifications and achieves the most optimum manufacturing cycle. The present invention overcomes the deficiencies of the prior art by providing a fully integrated process and apparatus 30 in which all aspects of the assembly are monitored and controlled closely.

While preferred embodiments have been shown and described, various modifications and substitutions may be made thereto without departing from the spirit and scope of the invention. Accordingly, it is understood that the present invention has been described by way of illustrations and not limitation.

What is claimed is:

1. A process for continuously winding a magnetic material in and through openings formed in a pair of bobbins to form a wound core of an electrical transformer, comprising:

inserting the pair of bobbins into a cavity formed in a winding fixture;

feeding the magnetic material into the winding fixture so that the magnetic material is fed into a circular winding action such that a leading edge of the magnetic material is continuously threaded into the openings formed in the pair of bobbins to form a wound transformer core;

cutting the magnetic material to form a trailing edge;

securing the trailing edge to underlying wound transformer core material; and shaping the wound transformer core to a predetermined shape.

2. The process of claim 1, wherein the winding fixture comprises a split die assembly including a first die and a second die, a slot being formed between the first and second dies which receives the magnetic material as it is fed into the winding fixture, the first and second dies each having a concave surface to direct the magnetic material through the openings of the first and second bobbins.

3. The process of claim 1, wherein the feeding comprises:

feeding the magnetic material along a first arcuate surface of a first die, the first arcuate surface directing the magnetic material through the opening formed in the first bobbin so that the magnetic material is fed along a first concave surface of the second die which directs the magnetic material through the opening formed in the second bobbin, the magnetic material being continuously fed through the openings formed in the first and second bobbins to form a wound core.

4. The process of claim 3, further comprising:

feeding the magnetic material to a second concave surface formed in the second die opposite the first concave surface, wherein the second concave surface directs the magnetic material to the opening formed in the second bobbin and directs the magnetic material to the opposing first concave surface.

5. The process of claim 1, wherein securing the trailing edge comprises:

welding a predetermined location of trailing edge to the underlying wound transformer core material.

6. The process of claim 5, wherein the welding of the trailing edge comprises plasma welding.

7. The process of claim 3, wherein the first concave surface is spring-loaded so that the magnetic material is initially fed into the winding fixture when the first and second concave are in an expanded, the first concave surface being forcibly moved in a direction away from the second concave as the magnetic material continuously winds around the first and second bobbins to accommodate the magnetic material between the first and second concave surfaces.

8. The process of claim 1, wherein shaping the wound transformer core to the predetermined shape, comprises:

compressing an upper surface of the wound transformer core with a first form die; and compressing a lower surface of the wound transformer core with a second form die.

9. A process for continuously winding a magnetic material in and through an opening formed in at least one bobbin to form a wound core of an electrical transformer, comprising:

inserting the at least one bobbin into a cavity formed in a winding fixture;

feeding the magnetic material into the winding fixture so that the magnetic material is fed into a circular winding action such that a leading edge of the magnetic material is continuously threaded into the opening formed in the at least one bobbin to form a wound transformer core;

cutting the magnetic material to form a trailing edge;

securing the trailing edge to underlying wound transformer core material; and shaping the wound transformer core to a predetermined shape.

* * * * *